US006002106A

United States Patent [19]

Kataoka et al.

[11] Patent Number: 6,002,106

[45] Date of Patent: Dec. 14, 1999

[54] FIXING DEVICE

[75] Inventors: Hiroshi Kataoka, Susono; Masaharu Ohkubo, Yokohama, both of Japan

[73] Assignee: Canon Kabushiki Kaisha, Tokyo, Japan

[21] Appl. No.: 08/995,151

[22] Filed: Dec. 19, 1997

[30] Foreign Application Priority Data

Dec. 24, 1996 [JP] Japan ..... 8-343478

[51] Int. Cl.[6] ..... G03G 15/20

[52] U.S. Cl. ..... 219/216; 399/324; 399/333

[58] Field of Search ..... 219/216; 399/324, 399/333; 492/46; 118/60; 432/60, 228

[56] References Cited

U.S. PATENT DOCUMENTS

| | | | |
|---|---|---|---|
| 5,253,024 | 10/1993 | Okuda et al. | 399/324 |
| 5,264,902 | 11/1993 | Suwa et al. | 399/333 |
| 5,287,153 | 2/1994 | Senba | 399/324 |
| 5,331,385 | 7/1994 | Ohtsuka et al. | 219/216 |
| 5,420,679 | 5/1995 | Goto et al. | 219/216 |
| 5,561,511 | 10/1996 | Mizunuma et al. | 399/333 |

FOREIGN PATENT DOCUMENTS

| | | |
|---|---|---|
| 572020 | 12/1993 | European Pat. Off. . |
| 63-313182 | 12/1988 | Japan . |
| 2-157878 | 6/1990 | Japan . |
| 4-44075 | 2/1992 | Japan . |
| 4-44076 | 2/1992 | Japan . |
| 4-44077 | 2/1992 | Japan . |
| 4-44078 | 2/1992 | Japan . |
| 4-44079 | 2/1992 | Japan . |
| 4-44080 | 2/1992 | Japan . |
| 4-44081 | 2/1992 | Japan . |
| 4-44082 | 2/1992 | Japan . |
| 4-44083 | 2/1992 | Japan . |
| 4-204980 | 7/1992 | Japan . |
| 4-204981 | 7/1992 | Japan . |
| 4-204982 | 7/1992 | Japan . |
| 4-204983 | 7/1992 | Japan . |
| 4-204984 | 7/1992 | Japan . |
| 5-72934 | 3/1993 | Japan . |

*Primary Examiner*—Joseph Pelham
*Attorney, Agent, or Firm*—Fitzpatrick, Cella, Harper & Scinto

[57] ABSTRACT

In a fixing device, a recording material having an unfixed toner image formed thereon is inserted between a pair of rotating members, and the toner image is fixed on the recording material by heating/pressing the recording material having the unfixed toner image formed thereon. By providing the fixing device with a releasing layer, made of a PFA resin having end groups of —$CF_3$, formed on a surface of a fixing rotating member, which serves as one of the pair of rotating members, contacting the unfixed toner image, and a releasing layer, having a volume resistivity of $10^{13}$–$10^{15}$ Ω·cm (when applying a DC voltage of 500 V) and made of a PFA resin containing a conductivity providing material, formed on a surface of a pressing rotating member, which serves the other one of the pair of rotating members, a problem of offset is solved.

8 Claims, 5 Drawing Sheets

FIXING DEVICE

BACKGROUND OF THE INVENTION

1. Field of the Invention

The present invention relates to a fixing device which fixes an unfixed toner image on a recording material as a permanent image by heating/pressing the recording material having the unfixed toner image.

2. Description of the Related Art

A typical conventional image fixing device used in an image forming apparatus, in which a toner image is transferred onto a recording material as an unfixed image, and a permanent image is provided by fixing the unfixed image by heating/pressing the recording material, is configured as shown in FIG. 1. In FIG. 1, a fixing roller 1 is a fixing rotating member, serving as recording-material conveying means, and includes a releasing layer 12 made of a fluororesin, such as PTFE (polytetrafluoroethylene) or the like, formed on a core bar 11 made of aluminum, iron or the like, and a heater 3, serving as heating means, incorporated within the fixing roller 1 for heating the fixing roller 1 from inside.

A pressing roller 2 is a pressing rotating member, and is pressed against the fixing roller 1 by pressing means (not shown) to form a fixing nip N. The pressing roller 2 includes a releasing layer 23 made of a fluororesin, such as PFA, PTFE or the like, having an excellent releasing property, formed on an elastic layer 22 made of a heat-resistant silicone sponge rubber or the like, which is formed on a core bar 21 made of aluminum, iron or the like.

The releasing layer 12 prevents an "offset" phenomenon in which a toner image is transferred onto the fixing roller 1 to stain the succeeding image. The offset phenomenon is more assuredly prevented by applying a bias voltage having the same polarity as the polarity of toner to the core bar 11 from a fixing bias power supply 8 by utilizing static charges particular to the toner. (While FIG. 1 illustrates a case in which the toner has a negative polarity, a positive fixing bias polarity is applied to the toner when the toner has a positive polarity.)

The releasing layer 23 prevents the offset toner transferred from the recording material toward the pressing roller 2 via the fixing roller 1 and the toner adhering to the back surface of the recording material from adhering to the surface of the pressing roller 2.

The cathode and the anode of a diode 9 are connected to the core bar 21 of the pressing roller 2 and the ground of the main body of the apparatus, respectively, in order to prevent the potential of the core bar 21 of the pressing roller 2 from being negative. Thus, a potential difference is provided between the surface of the fixing roller 1 and the core bar 21 of the pressing roller 2, to prevent the offset phenomenon by the electric field produced by the potential.

Unfixed toner 7 is fixed on the recording material by being heated/pressed at the fixing nip N.

An entrance guide 4 guides the recording material 6 having the unfixed toner image formed thereon so as to be conveyed to the fixing nip N, where the unfixed toner image is fixed as a permanent image on the recording material 6.

A thermistor 5, serving as a temperature detection sensor for detecting the surface temperature of the fixing roller 1, contacts the surface of the fixing roller 1 with a predetermined contact pressure, and turns on/off (an electric circuit for turning on/off power supply is not shown) power supply to the heater 3 so that the temperature of the fixing roller 1 is maintained constant.

When forming the releasing layer 12 of the fixing roller 1 with a PFA (a tetrafluoroethylene-perfluoroalkyl vinyl ether copolymer) resin, although thermoplasticity is superior to other fluororesins, a current flows through a local portion when a bias voltage is applied, so that the releasing layer 12 is degraded at that portion, to degrade the releasing property and to cause adherence of toner. A portion where the toner adheres causes a partial defect in the fixed toner image formed on the recording material. As an effective method for solving this problem, the use of a PFA resin having end groups of —$CF_3$ has been proposed (Japanese Patent Laid-Open Application (Kokai) No. 5-72934 (1993)).

When forming the releasing layer 12 of the fixing roller 1 with the PFA resin having end groups of —$CF_3$, although it is advantageous to also form the releasing layer 23 of the pressing roller 2 with a PFA resin from the viewpoint of releasability, there is a problem of causing an electrostatic offset phenomenon in toner.

SUMMARY OF THE INVENTION

It is an object of the present invention to solve the offset phenomenon occurring in a fixing device in which a releasing layer of a fixing rotating member is formed with a PFA resin having end groups of —$CF_3$, and a releasing layer of a pressing rotating member is formed with a PFA resin.

According to one aspect, the present invention which achieves the above-described object relates to a fixing device in which a recording material having an unfixed toner image formed thereon is inserted between a pair of rotating members, and the toner image is fixed on the recording material by heating/pressing the recording material having the toner image formed thereon, comprising a releasing layer, made of a PFA resin having end groups of —$CF_3$, formed on a surface of a fixing rotating member, which serves as one of the pair of rotating members, contacting the unfixed toner image, and a releasing layer, having a volume resistivity of $10^{13}$–$10^{15}$ Ω·cm (when applying a DC voltage of 500 V) and made of a PFA resin containing a conductivity providing material, formed on a surface of a pressing rotating member, which serves the other one of the pair of rotating members.

The reason why the fixing device of the present invention does not produce offset can be considered as follows.

A recording material conveyed to the fixing device during a continuous copying operation has a polarity peculiar to the toner, for example, a negative polarity, on a surface having a toner image, and a positive polarity on the back surface due to the polarity of toner holding charges. Accordingly, the surface of the fixing rotating member is positively charged by being rubbed with the recording material having charges, thereby cancelling a negative DC bias voltage applied in order to prevent offset, and degrading the effect of suppressing offset. Furthermore, the surface of the pressing rotating member is negatively charged, thereby reducing the electric field between the fixing rotating member and the pressing rotating member, and also degrading the effect of suppressing offset.

On the other hand, in the present invention, by reducing the resistivity of the releasing layer of the pressing rotating member to a value equal to or less than $10^{15}$ Ω·cm, positive charges on the surface of the fixing rotating member generated by frictional electrification are released, to maintain the fixing bias potential at a predetermined set value and to suppress surface charging of the pressing rotating member, so that adherence of toner to the fixing rotating member during fixing, i.e., offset, can be prevented. Since the PFA resin has a high resistivity, a conductivity providing material, such as carbon fine particles, titanium monooxide, tin oxide or the like, is added in order to reduce the resistivity. At that time, as the amount of mixture of the conductivity providing material increases, the releasing property of the PFA resin decreases, so that toner adhering to the back surface of the recording material adheres to the surface of the pressing rotating member, for example, during a duplex copying operation. If the toner adheres to the surface of the pressing rotating member, the releasing property further decreases, so that the adherence of the toner easily occurs.

Accordingly, in order to prevent excessive reduction of the releasing property of the releasing layer, made of PFA resin, of the pressing rotating member, the percentage content of the conductivity providing material is controlled so that the resistivity of the releasing layer is not lower than $10^{13}$ Ω·cm.

The foregoing and other objects, advantages and features of the present invention will become more apparent from the following description of the preferred embodiments taken in conjunction with the accompanying drawings.

DESCRIPTION OF THE PREFERRED EMBODIMENTS

A PFA resin having end groups of —$CF_3$ used for forming the releasing layer of the fixing rotating member can be obtained by replacing end groups of —COF of the PFA resin by —$CF_3$.

A commercially available PFA resin having end groups of —$CF_3$ is Teflon 45 OHP-J (product name, made by Mitsui-DuPont Fluorochemical Kabushiki Kaisha). A PFA resin for forming the releasing layer of the pressing rotating member may include or may not include end groups of —$CF_3$. In order to efficiently utilize a fixing bias voltage applied for the purpose of preventing offset as a potential difference between the fixing rotating member and the pressing rotating member, the resistance value of the releasing layer of the fixing rotating member is preferably high. More specifically, the volume resistivity of the releasing layer of the fixing rotating member is preferably $10^{14}$–$10^{16}$ Ω·cm (when applying a DC voltage of 500 V).

From the viewpoint of stability of the property of the PFA resin, a PFA tube is preferably used as the releasing layer.

In order to form a sufficient nip width with the fixing rotating member, it is preferable to provide an elastic layer under the releasing layer of the pressing rotating member. From the viewpoint of preventing offset, the volume resistivity of the elastic layer is preferably $10^3$–$10^6$ Ω·cm (when applying a DC voltage of 100 V), and the resistance value of the entire pressing rotating member is preferably $10^{10}$–$10^{13}$ Ω (when applying a DC voltage of 500 V).

First Embodiment

Figure 1:
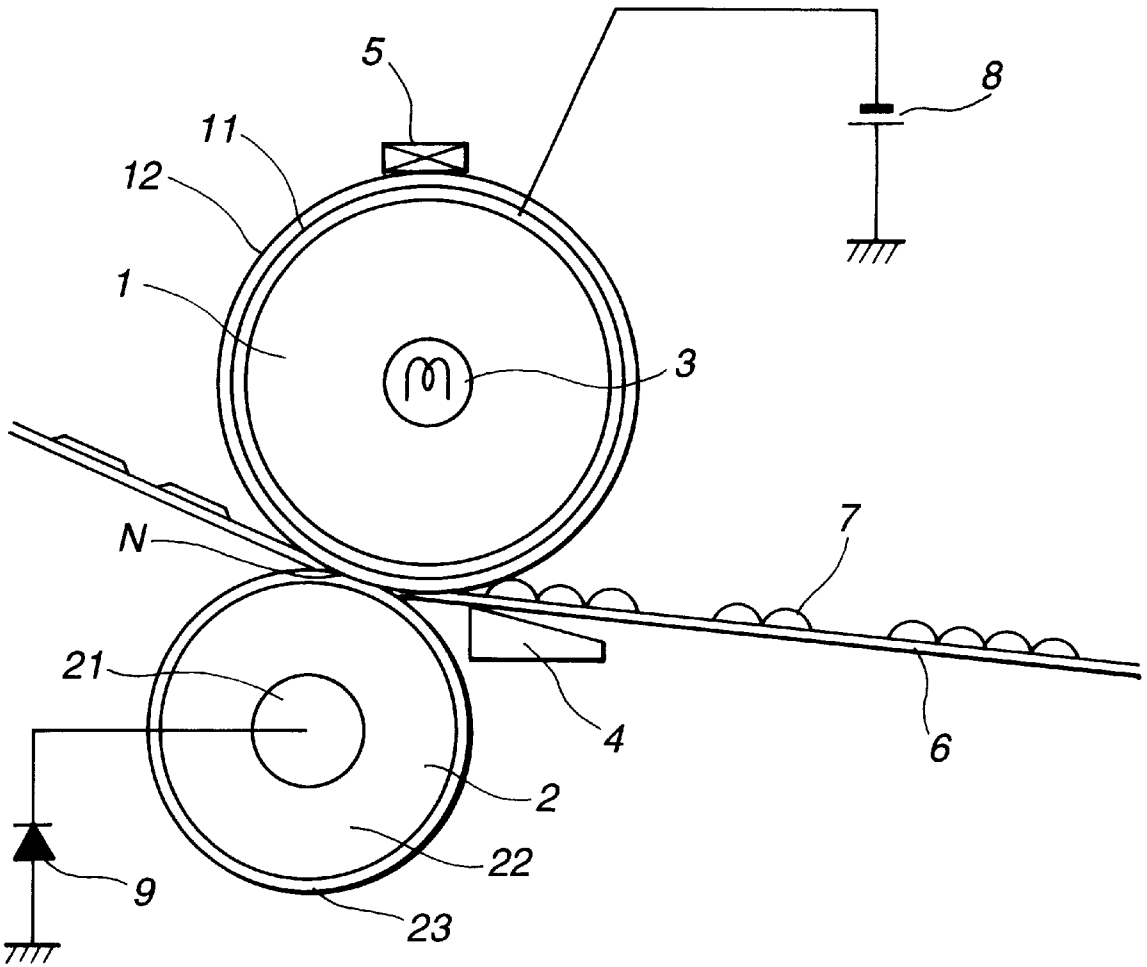
FIG. 1 is a diagram illustrating the configuration of a fixing device.

A first embodiment of the present invention will now be described with reference to FIG. 1.

In the configuration of the fixing device in the first embodiment, a description about the same portions as those in the conventional device will be omitted. A description will also be omitted about a widely known electrophotographic image forming apparatus.

The image forming apparatus used in the first embodiment can perform printing on 25 sheets per minute in a condition of passing a shorter side of an A4-size recording material.

A fixing roller 1 includes a core bar 11 made of aluminum having a diameter of 40 mm and a thickness of 1 mm, and a PFA tube 50 μm thick coated thereon as a releasing layer 12. A PFA resin having end groups of —$CF_3$ (product name: 450 OHP-J) is used as the PFA resin which is a feature of the present invention. Instead of coating the tube on the core bar 11, the releasing layer 12 may also be formed by spray coating the PFA resin on the core bar 11 followed by firing. By applying a DC voltage of −700 V to the core bar 11 of the fixing roller 1 from a DC power supply 8 as a fixing bias voltage, the surface potential of the fixing roller 1 is maintained at about −650 V, to provide a potential difference for preventing offset between the fixing roller 1 and a pressing roller 2.

The pressing roller 2 includes an iron core bar 21 having a diameter of 14 mm, an elastic layer 22 8 mm thick, made of silicone sponge rubber, coated thereon, and a releasing layer 23 50 μm thick, coated on the releasing layer 22, made of a PFA resin (product name: PFA 350-J, made by Mitsui-DuPont Fluorochemical Kabushiki Kaisha) having a volume resistivity of $10^{15}$ Ω·cm (when applying a DC voltage of 500 V) in the form of a tube. The pressing roller 2 has a hardness of about 56 degrees (measured by an Asker-C hardness meter with a load of 1 Kg). By pressing the pressing roller 2 against the fixing roller 1 with a pressing force of 20 N (Newton), a fixing nip having a width of about 5 mm is obtained. The cathode and the anode of a diode 9 having a breakdown voltage of 2 KV are connected to the core bar 21 of the pressing roller 2 and to the ground of the main body of the apparatus, respectively, in order to maintain the surface of the pressing roller 2 to a positive potential.

The reason why the volume resistivity of the PFA resin used for the releasing layer 23 on the surface of the pressing roller 2 is to be controlled within the range of $10^{13}$–$10^{15}$ Ω·cm (when applying a DC voltage of 500 V) will now described with reference to Table 1 which illustrates the results of experiments relating to adherence of toner to the pressing roller 2. In the experiment, PFA 450 HP-J was used for the releasing layer 12 on the fixing roller 1. Durability tests were performed by changing the volume resistivity of the PFA resin on the surface of the pressing roller 2 as $10^{12}$ Ω·cm, $10^{13}$ Ω·cm, $10^{15}$ Ω·cm, and $10^{16}$ Ω·cm (when applying a DC voltage of 500 V), and the state of adherence of toner to the pressing roller 2 and the fixing roller 1, generation of black spots on the image, and the like were confirmed. The volume resistivity of the elastic layer 22 of the pressing roller 2 used in this experiment was about $10^6$ Ω·cm (when applying a DC voltage of 100 V), and the resistance values of the entire pressing roller 2 were $10^9$ Ω, $10^{10}$ Ω, $10^{13}$ Ω, and $10^{14}$ Ω (when applying a DC voltage of 500 V). These resistance values were measured by applying a DC voltage of 500 V between the core bar 11 of the fixing roller 1 and the core bar 21 of the pressing roller 2 in a state in which the pressing roller 2 contacts the fixing roller 1 with a predetermined pressure (20 N). A4-size ordinary paper having a weighing of 80 g·m$^2$ and containing 18% of calcium carbonate as a filler was used as the recording material to be passed through the nip portion.

TABLE 1

| Number of passed sheets | Volume resistivity (Ω · cm) $10^{12}$ | $10^{13}$ | $10^{15}$ | $10^{16}$ |
|---|---|---|---|---|
| Initial | No problem | No problem | No problem | Offset occurs |
| 2,000 | No problem | No problem | No problem | Offset occurs |
| 5,000 | Toner starts adhering to the pressing roller | No problem | No problem | Offset occurs |
| 10,000 | Toner starts adhering to the pressing roller | No problem | No problem | Offset |
| 20,000 | Black spots appear in the image | No problem | No problem | — |
| 30,000 | — | No problem | No problem | — |
| 50,000 | — | No problem | No problem | — |

As is apparent from Table 1, when a PFA resin in which carbon particles were dispersed so that the volume resistivity of the releasing layer 23 of the pressing roller 2 is $10^{13}$–$10^{15}$ Ω·cm was used, since a high releasing property which is a feature of the PFA resin was not impaired, adherence of toner to the pressing roller 2 could be prevented from the initial stage up to 50,000 passed sheets, and black spots did not appear in the image.

On the other hand, when carbon particles were dispersed in the PFA resin so that the volume resistivity of the releasing layer 23 of the pressing roller 2 is equal to or less than $10^{12}$ Ω·cm, the releasing property which is the feature of the PFA resin was impaired. As a result, the toner adhered to the pressing roller 2, the back surface of the recording material was stained, and black spots appeared in the image. When carbon particles were dispersed so that the volume resistivity of the releasing layer 23 of the pressing roller 2 is equal to or more than $10^{16}$ Ω·cm, or when the pressing-roller tube was formed only with the PFA resin without dispersing carbon particles, positive charges producing a charging potential generated on the surface layer of the fixing roller 2 could not be released, thereby causing the offset phenomenon.

Second Embodiment

A second embodiment of the present invention will now be described with reference to FIG. 2.

Figure 2:
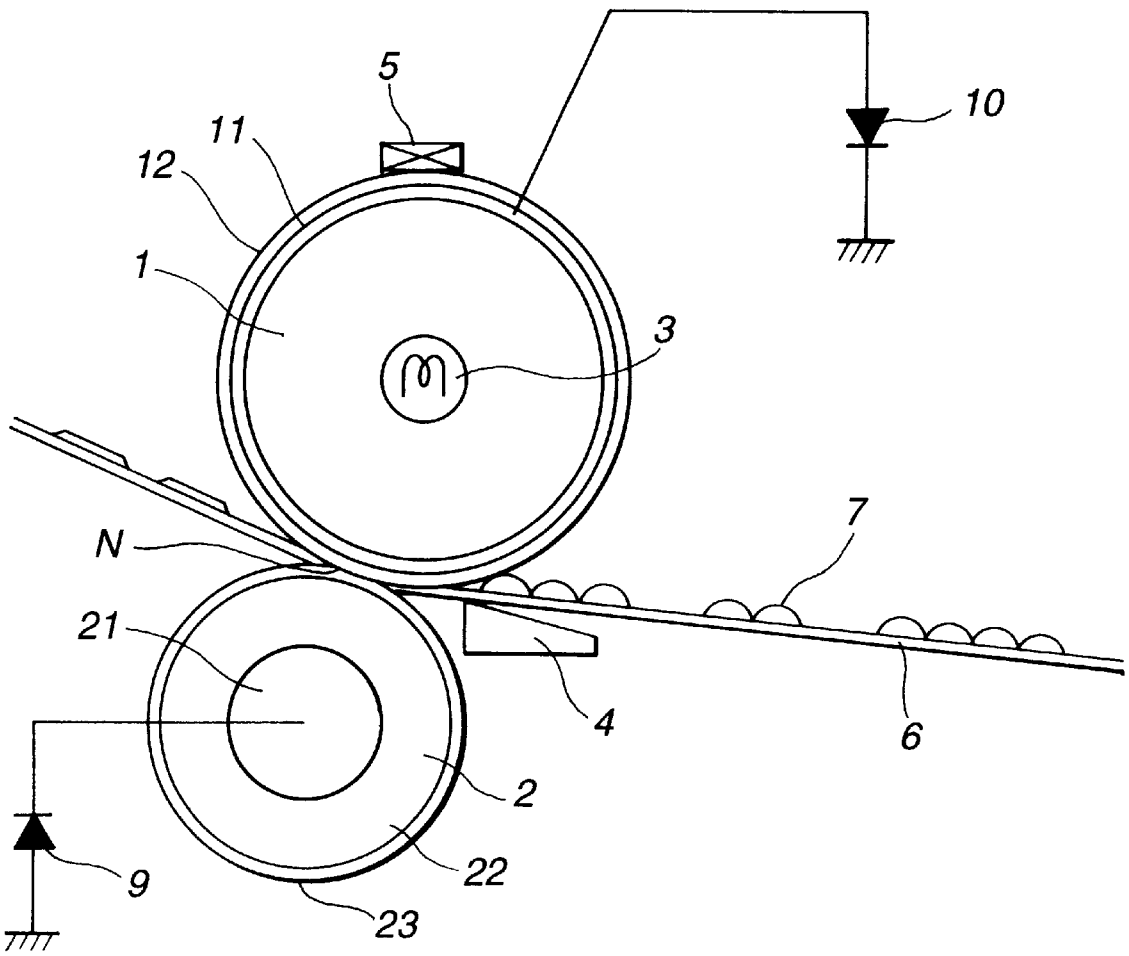
FIG. 2 is a diagram illustrating the configuration of a fixing device according to a second embodiment.

In the configuration of a fixing device shown in FIG. 2, a description about the same portions as those shown in the first embodiment will be omitted.

An image forming apparatus used in the second embodiment can perform printing on 12 sheets per minute in a condition of passing a longer side of an A4-size recording material.

A fixing roller 1 includes a core bar 11 made of aluminum having a diameter of 25 mm and a thickness of 2 mm, and a PFA tube 30 μm thick coated thereon as a releasing layer 12. In the second embodiment, also, a PFA resin having end groups of —$CF_3$ (product name: 450 OHP-J) is used for the PFA tube serving as the surface layer of the fixing roller 1. The anode and the cathode of a diode 10 having a breakdown voltage of 1.5 KV are connected to the core bar 11 of the fixing roller 1 and to the ground of the main body of the apparatus, respectively, in order to release positive charges on the surface of the fixing roller 1, and to provide a potential difference for preventing offset between the fixing roller 1 and a pressing roller 2.

The pressing roller 2 includes an iron core bar 21 having a diameter of 11 mm, an elastic layer 22 7 mm thick, made of silicone solid rubber, coated thereon, and a releasing layer 23, coated on the releasing layer 22 30 μm thick, made of a PFA resin (product name: PFA 350-J, made by Mitsui-DuPont Fluorochemical Kabushiki Kaisha) having a volume resistivity of $10^{14}$ Ω·cm (when applying a DC voltage of 500 V) in the form of a tube. The pressing roller 2 has a hardness of about 44 degrees (measured by an Asker-C hardness meter with a load of 500 g). By pressing the pressing roller 2 against the fixing roller 1 with a pressing force of 9 N, a fixing nip N having a width of about 2.5 mm is obtained. The cathode and the anode of a diode 9 having a breakdown voltage of 1.5 KV are connected to the core bar 21 of the pressing roller 2 and to the ground of the main body of the apparatus, respectively, in order to maintain the surface of the pressing roller 2 to a positive potential.

In the second embodiment, also, in order to stably maintain a potential difference between the pressing roller 2 and the fixing roller 1, the resistance value of the releasing layer 12 on the fixing roller 1 is preferably high. More specifically, the volume resistivity of the releasing layer 12 is preferably $10^{14}$–$10^{16}$ Ω·cm (when applying a DC voltage of 500 V), and is $8\times10^{15}$ Ω·cm in the second embodiment.

Next, the reason why silicone solid rubber is used for the elastic layer 22 of the pressing roller 2 in the second embodiment will be described.

Figure 3:
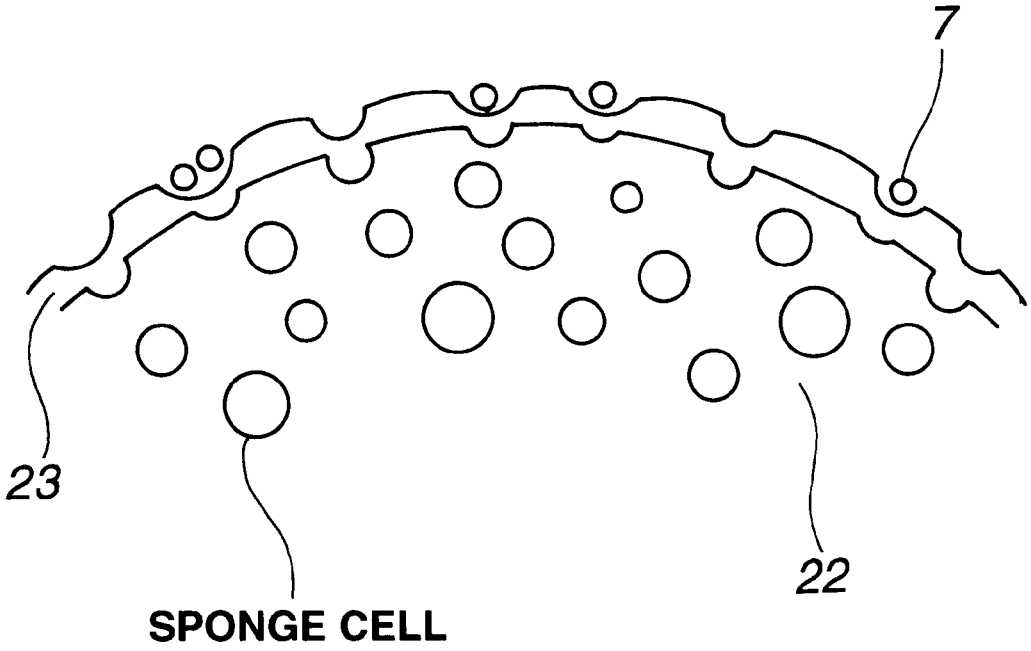
FIG. 3 is a schematic diagram illustrating the occurrence of adherence of toner.

In the pressing roller using a sponge rubber as described in the first embodiment, a very thin PFA-resin layer about 30–50 μm thick is coated on the sponge-rubber layer. Hence, as shown in FIG. 3, toner particles enter recesses produced in accordance with the shape of foamed sponge cells. Some of these particles may move to flat portions. In the second embodiment, by using a solid rubber for the elastic layer 22, projections and recesses are not produced on the surface of the pressing roller 2, thereby preventing the occurrence of adherence of toner. Furthermore, by using a high-resistivity PFA resin having a volume resistivity of $10^{13}$ Ω·cm (when applying a DC voltage of 500 V) for the surface layer of the pressing roller 2, a high releasing property is maintained. The volume resistivity of the elastic layer 22 was $10^5$ Ω·cm (when applying a DC voltage of 100 V), and the resistance value of the pressing roller 2 was $10^{10}$ Ω·cm (when applying a DC voltage of 500 V).

Table 2 illustrates the results of experiments in which the state of toner adhering to the surface of the pressing roller 2 was observed when the silicone sponge rubber was used for the pressing roller 2, and in the second embodiment. A4-size ordinary paper having a weighing of 80 g·m$^2$ and containing about 20% of calcium carbonate as a filler was used as the recording material in the experiments.

TABLE 2

| Number of passed sheets | Second embodiment | Silicone sponge rubber (First embodiment) |
|---|---|---|
| Initial | No problem | No problem |
| 30,000 | No problem | No problem |
| 50,000 | No problem | No problem |
| 60,000 | No problem | Adheres to the pressing roller |
| 80,000 | Toner starts slightly adhering to the surface of the pressing roller | Adherence of toner to the pressing roller further proceeds |

As can be seen from Table 2, in the second embodiment in which the solid rubber was used for the elastic layer 22 of the pressing roller 2, toner started slightly adhering to the entire surface of the pressing roller when 80,000 sheets passed. On the other hand, in the system using the sponge rubber, adherence of toner to recesses on the surface of the pressing roller 2 started when the number of passed sheets exceeded 50,000, and the toner adhered to the entire surface of the pressing roller when 80,000 sheets passed.

Third Embodiment

Figure 4:
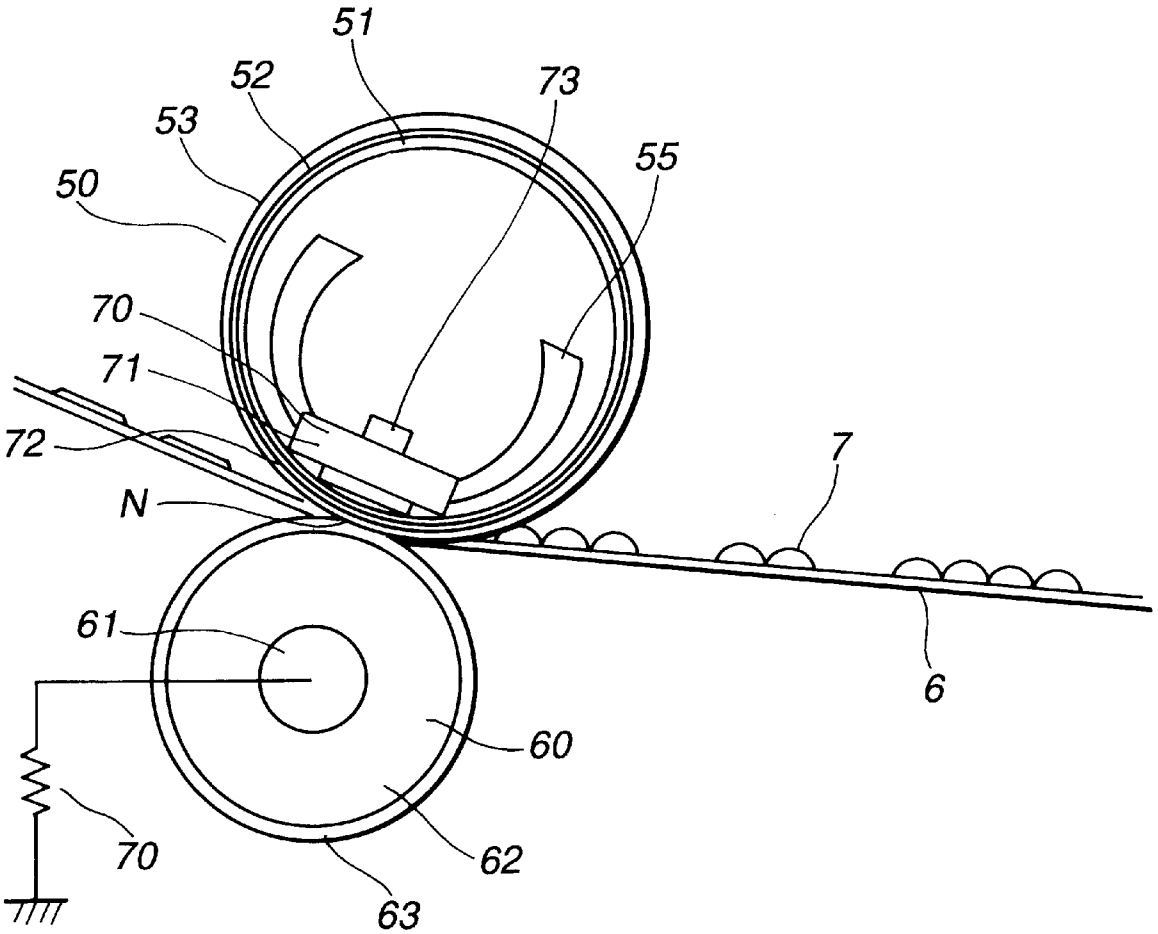
FIG. 4 is a diagram illustrating the configuration of a fixing device according to a third embodiment of the present invention.

A third embodiment of the present invention will now be described with reference to FIG. 4.

The third embodiment relates to a fixing device according to a film heating method in which a film having a very small heat capacity, serving as a heating rotating member, is heated from the inside.

Such film heating methods have been proposed, for example, in Japanese Patent Laid-Open Application Nos. 63-313182 (1988), 2-157878 (1990), 4-44075-44083 (1992), and 4-204980-204984 (1992).

The fixing device includes a thin heat-resistant film (or sheet) 50, a heating member (heater) 70, subjected to temperature control at a constant temperature, provided near the inner surface of the film 50, and a pressing roller 60 provided so as to face the heater 70. When executing fixing of an image, the film 50 is rotated in the same direction and at the same speed as a recording material conveyed between the film 50 and the pressing roller 60. By passing the recording material through a fixing nip N formed by pressure contact between the heater 70 and the pressing roller 60 via the film 50, the surface having an unfixed toner image of the recording material is heated and pressed via the film 50, so that the unfixed toner image is fused and fixed on the recording material.

In order to reduce the heat capacity and to improve the quick start property, the film 50 has a multilayer structure about 50–20 $\mu$m thick provided in consideration of the heat resistant property, the releasing property, durability, heat conductivity, and the like.

The film 50 used in the second embodiment includes a base layer 51, a primer layer 52, and a releasing layer 53. The base layer 51 is obtained by dispersing 45 wt % of magnesia (MgO), serving as a metal oxide having an excellent heat conductivity, in heat-resistant polyimide (PI). The primer layer 52 is used for securing adhesiveness between the base layer 51 and the releasing layer 53, and is obtained by dispersing titanium oxide ($TiO_2$) in an adhesive comprising a polyimide resin and a fluororesin in order to provide conductivity. The releasing layer 53 was obtained by dispersing 0.3 wt % of conductive carbon particles in a fluororesin PFA 450 HP-J having end groups of —$CF_3$, which is the feature of the present invention.

A heat holder 55 adiabatically supports the heater 70.

The pressing roller 60 includes an iron core bar 61 having a diameter of 10 mm, an elastic layer 62 6 mm thick, made of a conductive silicone rubber, coated thereon, and a releasing layer 63 40 $\mu$m thick, coated on the elastic layer 62, made of a PFA resin (product name: 350-J) having a volume resistivity of $10^{15}$ Ω19 cm (when applying a DC voltage of 500 V) in the form of a tube. The pressing roller 60 has a diameter of 23 mm and a hardness of about 42 degrees (measured by an Asker-C hardness meter with a load of 500 g). By pressing the pressing roller 60 against the film 50 with a pressing force of 8 N, a fixing nip N having a width of about 3 mm is obtained. The conductive silicone sponge rubber forming the elastic layer 62 had a volume resistivity of $10^6$ Ω·cm (when applying a DC voltage of 100 V), and the resistance value of the pressing roller 60 was $10^{11}$ Ω (when applying a DC voltage of 500 V).

The film 50 is rotated by being driven by the rotation of the pressing roller 60 at the same speed as the conveying speed of the conveyed recording material without producing creases.

Figure 5:
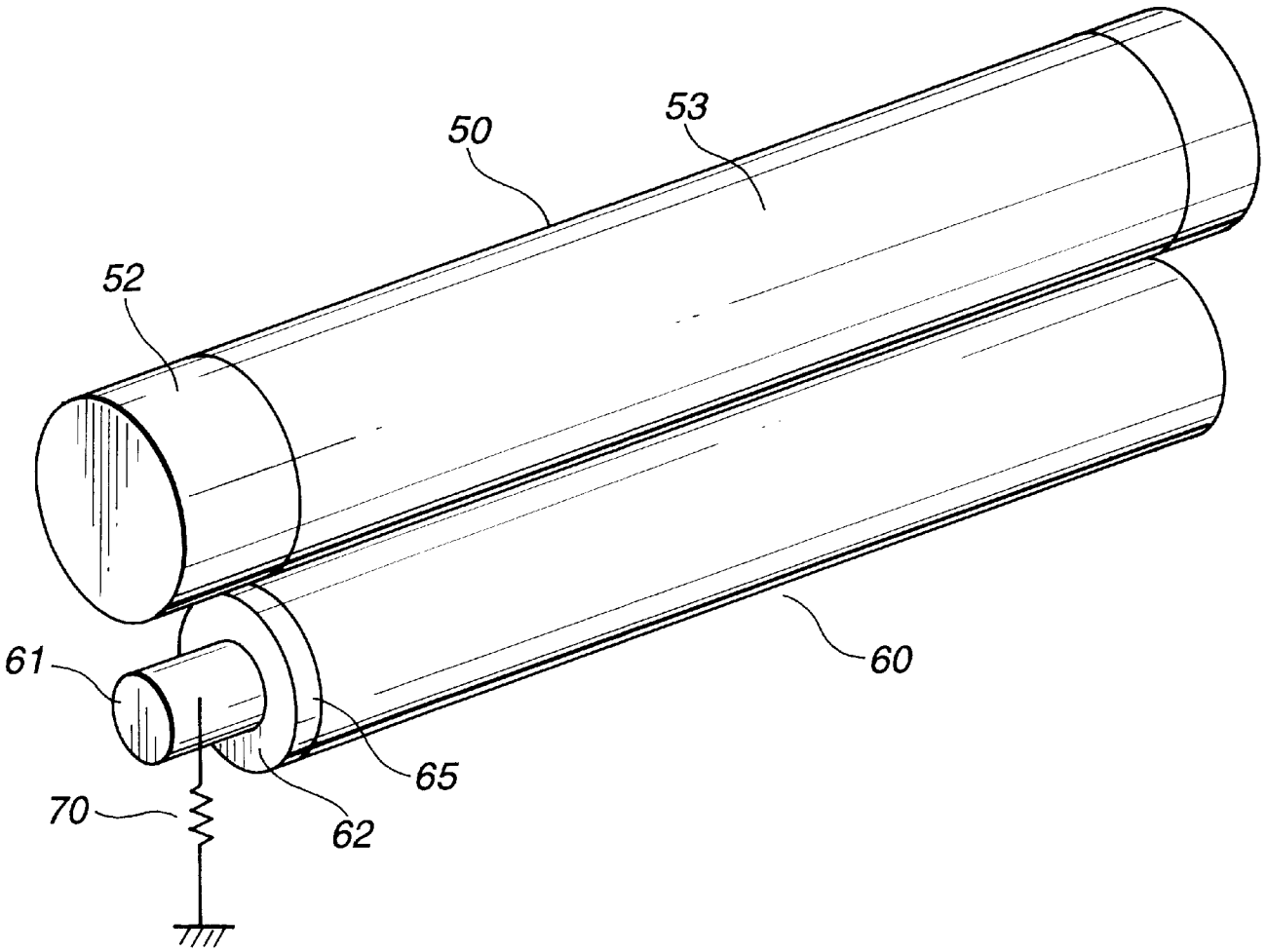
FIG. 5 is a diagram illustrating a film heating method according to the third embodiment.

In the second embodiment, as shown in FIG. 5, a medium-resistance rubber ring 65 having a resistivity of about $10^6$–$10^{10}$ Ω·cm (when applying a DC voltage of 100 V) is provided at an end portion of the pressing roller 60 so as to contact the primer layer 52 of the film 50. The core bar 61 of the pressing roller 60 is connected to the ground of the main body of the apparatus via a resistor 70 having a resistance value of 100 M Ω. According to such a configuration, offset is prevented.

The heater 70 includes a linearly-formed silver-palladium (Ag/Pd) current passing member 72, serving as a heating source, provided on one surface of a ceramic substrate 71 made of $Al_2O_3$ (alumina), which is an electrically insulating, heat resistant, and low-heat-capacity material. The surface of the current passing member 72 is coated with a glass layer having an excellent electrical insulating property. A thermistor 73, serving as a temperature detector, a temperature fuse and the like are provided on the other surface of the heater 70. The heater 70 is subjected to temperature control so as to maintain the heater's temperature to a constant value according to current passing control from a control circuit (not shown).

When the above-described film-heating fixing device was used, the offset phenomenon in ordinary paper and OHP (overhead projector) sheets, adherence of toner to the pressing roller, and generation of black spots in the image were not observed.

The individual components shown in outline in the drawings are all well-known in the fixing device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fixing device in which a recording material having an unfixed toner image formed thereon is inserted between a pair of rotating members, and the toner image is fixed on the recording material by heating/pressing the recording material having the unfixed toner image formed thereon, said device comprising:

a releasing layer, made of a PFA resin having end groups of —$CF_3$, formed on a surface of a fixing rotating member, which serves as one of the pair of rotating members, contacting the unfixed toner image; and a releasing layer, having a volume resistivity of $10^{13}$–$10^{15}$ Ω·cm (when applying a DC voltage of 500 V) and made of a PFA resin containing a conductivity providing material, formed on a surface of a pressing rotating member, which serves the other one of the pair of rotating members.

2. A fixing device according to claim 1, wherein said releasing layer of the fixing rotating member has a volume resistivity of $10^{14}$–$10^{16}$ Ω·cm (when applying a DC voltage of 500 V).

3. A fixing device according to claim 1, wherein said releasing layer of the fixing rotating member comprises a PFA-resin tube.

4. A fixing device according to claim 1, further comprising an elastic layer under said releasing layer of the pressing rotating member.

5. A fixing device according to claim 4, wherein said elastic layer has a volume resistivity of $10^3$–$10^6$ Ω·cm (when applying a DC voltage of 100 V), and wherein the entire pressing rotating member has a volume resistivity of $10^{10}$–$10^{13}$ Ω·cm (when applying a DC voltage of 500 V).

6. A fixing device according to claim 4, wherein said releasing layer of the pressing rotating member comprises a PFA resin tube.

7. A fixing device according to claim 4, wherein said elastic layer comprises a solid rubber.

8. A fixing device according to claim 1, wherein the conductivity providing material comprises carbon fine particles.

* * * * *

UNITED STATES PATENT AND TRADEMARK OFFICE

CERTIFICATE OF CORRECTION

PATENT NO. : 6,002,106

DATED : December 14, 1999

INVENTOR(S): HIROSHI KATAOKA, ET AL.

It is certified that error appears in the above-identified patent and that said Letters Patent is hereby corrected as shown below:

COLUMN 6,
Line 65, "weighing" should read --weight--.

Signed and Sealed this

Twenty-third Day of January, 2001

*Attest:*

*Attesting Officer*

Q. TODD DICKINSON

*Commissioner of Patents and Trademarks*